US006866412B2

(12) United States Patent
Bachelier et al.

(10) Patent No.: US 6,866,412 B2
(45) Date of Patent: Mar. 15, 2005

(54) APPARATUS INCLUDING PUMP BUCKETS FOR HOMOGENIZING FREE-FLOWING SUBSTANCES

(75) Inventors: Heinz-Jurgen Bachelier, Volxheim (DE); Frank-Rudiger Boos, Bremen (DE)

(73) Assignee: Symex GmbH & Co. KG, Bremerhaven (DE)

( * ) Notice: Subject to any disclaimer, the term of this patent is extended or adjusted under 35 U.S.C. 154(b) by 158 days.

(21) Appl. No.: 09/784,637

(22) Filed: Feb. 15, 2001

(65) Prior Publication Data

US 2001/0036125 A1 Nov. 1, 2001

(30) Foreign Application Priority Data

Feb. 18, 2000 (DE) ..... 200 02 920 U

(51) Int. Cl.[7] ..... B01F 7/16

(52) U.S. Cl. ..... 366/294; 366/295; 366/296; 366/304

(58) Field of Search ..... 366/178.1, 293–296, 366/304, 315–317, 331, 136, 137, 292, 288, 96–97, 306–307; 416/197 R–197 C

(56) References Cited

U.S. PATENT DOCUMENTS

| | | | | |
|---|---|---|---|---|
| 204,124 | A | * | 5/1878 | Barret et al. |
| 1,624,037 | A | * | 4/1927 | Butler |
| 2,685,436 | A | | 8/1954 | Hasselquist |
| 2,723,110 | A | * | 11/1955 | Collins |
| 3,224,744 | A | * | 12/1965 | Broomall ..... 366/288 |
| 3,271,194 | A | * | 9/1966 | Oikawa |
| 3,308,171 | A | * | 3/1967 | Oikawa |
| 3,318,579 | A | | 5/1967 | Foucault |
| 3,580,546 | A | * | 5/1971 | Fraser et al. |
| 3,731,800 | A | * | 5/1973 | Timson |
| 3,845,938 | A | * | 11/1974 | Schold ..... 366/144 |
| 4,019,722 | A | * | 4/1977 | Shohet |
| 4,403,868 | A | * | 9/1983 | Kupka |
| 4,431,482 | A | * | 2/1984 | Heinbockel et al. |
| 4,691,867 | A | * | 9/1987 | Iwako et al. |
| 4,786,183 | A | | 11/1988 | Cadeo |
| 4,878,677 | A | * | 11/1989 | Larkins et al. |
| 4,883,363 | A | * | 11/1989 | Pillon et al. |
| 4,889,428 | A | * | 12/1989 | Hodson |
| 4,918,665 | A | * | 4/1990 | Herfeld |
| 5,253,937 | A | * | 10/1993 | Scheimann et al. |
| 5,309,403 | A | * | 5/1994 | Bartow |
| 5,460,444 | A | * | 10/1995 | Howorka |
| 5,590,961 | A | * | 1/1997 | Rasmussen |
| 5,779,360 | A | * | 7/1998 | Tanaka ..... 366/286 |
| 5,845,856 | A | * | 12/1998 | Tanaka et al. |
| 5,975,440 | A | | 11/1999 | Watson |
| 5,980,100 | A | * | 11/1999 | Haegeman |
| 6,227,698 | B1 | * | 5/2001 | Muntener |

FOREIGN PATENT DOCUMENTS

| | | |
|---|---|---|
| CH | 389577 | 7/1965 |
| DD | 280048 | 6/1990 |
| DD | 293059 | 8/1991 |
| DE | 553055 | 6/1932 |
| DE | 2413452 | 3/1974 |
| DE | 2509285 | 10/1975 |
| DE | 3220092 | 12/1983 |
| DE | 8215535.6 | 8/1985 |
| DE | 3417242 | 11/1985 |
| DE | 8414202.2 | 9/1987 |

(List continued on next page.)

*Primary Examiner*—Charles E. Cooley
(74) *Attorney, Agent, or Firm*—Wood, Herron & Evans, L.L.P.

(57) ABSTRACT

A homogenizer for homogenizing free-flowing substances, with a rotor which is mounted in a housing so that it can rotate and can be driven by a drive device. An element is mounted in the housing so that it can rotate and can be driven by a drive device independently of the rotor to homogenize and/or transport the liquid substance.

13 Claims, 7 Drawing Sheets

FOREIGN PATENT DOCUMENTS

| | | | |
|---|---|---|---|
| DE | 3715331 | | 12/1988 |
| DE | 3936706 | | 5/1990 |
| DE | 4209527 | | 9/1993 |
| DE | 4312835 | | 10/1994 |
| DE | 29608713 | | 9/1996 |
| DE | 19614295 | | 10/1996 |
| DE | 29822149 | | 5/1999 |
| EP | 0013547 | | 7/1980 |
| FR | 606508 | | 6/1926 |
| GB | 2047104 | | 11/1980 |
| GB | 2077618 | * | 12/1981 |
| GB | 2096638 | | 10/1982 |
| JP | 63-1430 | * | 1/1988 |
| JP | 2-6860 | * | 1/1990 |
| WO | WO 91/07223 | | 5/1991 |

* cited by examiner

APPARATUS INCLUDING PUMP BUCKETS FOR HOMOGENIZING FREE-FLOWING SUBSTANCES

FIELD OF THE INVENTION

The invention pertains to a homogenizer for homogenizing free-flowing substances, with a rotor which is mounted in a housing so that it can rotate and which is driven by a drive device.

BACKGROUND OF THE INVENTION

Homogenizers of this sort are utilized for example in the cosmetic, pharmaceutical and chemical industries in the manufacture of creams, salves, pastes and the like. The homogenizer is positioned for example at the lowest point of a container and/or disperses the liquid substance by the fact that the rotor together with a fixed stator applies shearing forces to the substance. The homogenizer could also be placed separately next to a container or between two containers. The homogenized substance can either be transported back into the container or into a filling facility.

In known homogenizers, the homogenization can be influenced mainly by varying the speed of rotation of the rotor with respect to the fixed stator, or by the concrete design of the rotor and/or stator. The shearing effect and also the transporting effect of the homogenizer are greater at high rotational speeds than at lower speeds. A disadvantage of the known homogenizers consists in the fact that the shearing effect and the transporting effect are directly interlinked. Moreover, in order to attain high shearing effects and high rotor speeds it is necessary for the drive mechanisms and drive motors to be of appropriately complex design.

An additional disadvantage consists in the fact that at too high a motor speed the shearing effect becomes so great that the substance which is to be homogenized is affected negatively and can even be damaged.

In order to be able to meet the requirement of high pumping performance (transport effect) while at the same time reducing the shearing effect at high rotational speeds, homogenizers have been developed which allow an axial shift of the rotor relative to the stator, in order to increase the free cross sections of flow (or gaps) between the blades of the rotor and the stator (see DE 296 08 712 and DE 24 13 452). The engineering complexity of such axial shifting ability is very high.

SUMMARY OF THE INVENTION

The task of the present invention is to provide a homogenizer with which the homogenizing effect can be influenced in a manner involving a simple design, and where the shearing effect and the pumping effect can be adjusted to the particular needs.

The invention solves this problem in the homogenizer of the type named at the beginning by means of an element which is mounted in the housing so that it can rotate and which can be driven by a drive device independently of the rotor to homogenize and/or transport the liquid substance.

The advantages of the invention consist primarily in the fact that by means of the additional element which can be driven separately from and independently of the rotor, the homogenizing and transporting can be influenced in a great variety of ways and can be adapted to the particular production needs. In particular by adjusting and varying the relative speed of the rotatable element relative to the rotor, the shearing effect of the rotor and of the rotatable element on the substance can be adjusted. The rotatable element can be driven in the same direction or counter to the rotor, so that the shearing effect can be varied continuously within great ranges. Furthermore, the shearing effect can be varied independently of the transport performance (i.e. the quantity of the substance which is transported). For example, the pumping performance can be held constant at a value dependent on the speed of rotation, while the shearing effect approaches zero as the rotatable element turns at the same or nearly the same speed in the same direction. The shearing effect is at its maximum at the maximum contrary speeds of rotation, while the same shearing effect requires a significantly lower absolute speed of rotation than in comparison to traditional homogenizers. Accordingly, the drives of the homogenizer according to the invention can be designed for lower speeds of rotation.

According to a variant of the invention, the rotatable element is in the form of an impeller with a number of pump buckets, in order to be able to achieve high pumping performance while the rotor essentially generates the shearing effect of the homogenizer.

For an alternative version it is proposed that the rotatable element be designed in the nature of a stator or rotor with blades. In principle this is a homogenizer with a "rotatable stator," in order to be able to generate the maximum shearing effect described earlier.

An especially preferred variant provides for the rotatable element and the rotor be coupled with two drive shafts which are coaxial to each other to drive the rotatable element and the rotor. This solution of simple design saves space. To reduce the weight and the costs of materials, one of the two drive shafts is preferably constructed as a hollow shaft.

It is expedient for the mounting of the drive shafts to be designed in such a way that the inner drive shaft is supported within the outer shaft by means of roller bearings, and the outer shaft in turn is supported within a housing.

To seal the interior of the homogenizer against the surroundings reliably even in the presence of high pressure differences and possibly aggressive media, it is proposed in accordance with a refinement that at least one sliding ring seal be used to seal the interior of the housing of the homogenizer from the surroundings. The interior spaces of a stirring container, to which a homogenizer in accordance with the invention can be connected, there are often positive or negative pressures which can be controlled reliably in this way.

A simply designed configuration of the rotor and the rotatable element provides for the rotor and/or the rotatable element to have a base plate which is coupled with the corresponding drive shaft, with the blades extending from it axially; the rotary axes of the drive shafts are positioned essentially vertically during operation, and each of the shafts is driven by a toothed belt. Instead of a toothed belt it is possible to use chains, V-belts, friction wheels, geared wheels or the like.

The shearing effect and the pumping effect can be varied in a simple manner by having the drive motors of the rotor and of the rotatable element controllable in such a way that the rotor and the rotatable element can be turned at adjustable relative speeds in the same or opposite directions, or optionally either the rotor or the rotatable element is driven while the other component is standing still.

An additional preferred variant provides that the housing of the homogenizers has an inlet opening through which the liquid material can flow into the interior axially from a container, and an outlet opening through which the homogenized liquid material flows essentially radially and/or tangentially out of the housing, and that there are two return lines which communicate with the outlet opening of the housing, through which the liquid substance can be conducted back to different locations in the container depending on the position of a control valve. In this way the substance can be fed back for example at the top of the container or close to the homogenizer, which is expedient when a small quantity of a substance is to be homogenized.

BRIEF DESCRIPTION OF THE DRAWINGS

The shearing effect can be further optimized by having additional fixed-position stator inter-leavings arranged on the housing of the homogenizer.

The invention is described in the next section on the basis of implementation examples, with reference to the accompanying drawings. The figures show the following.

DETAILED DESCRIPTION

Figure 1:
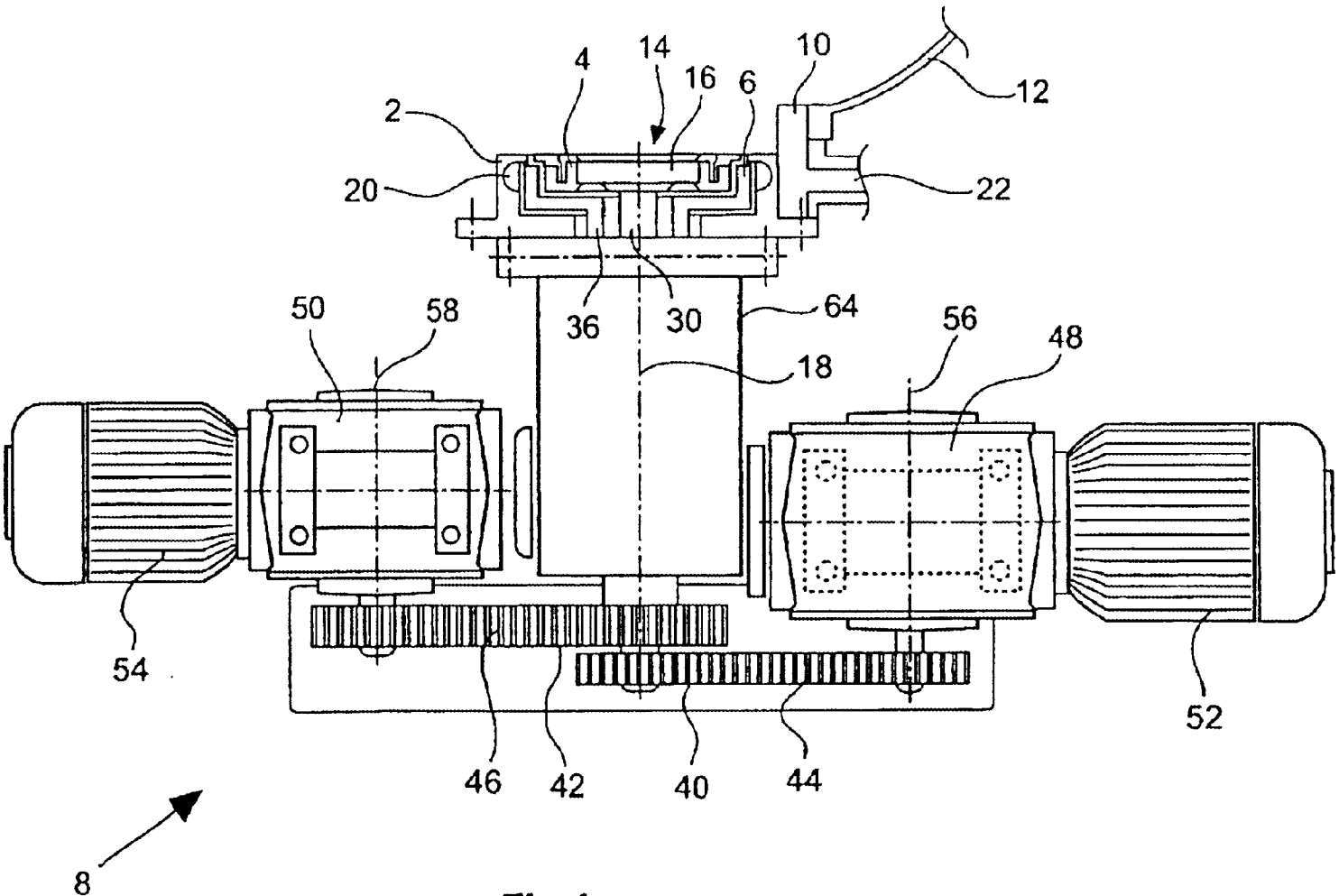
FIG. 1 illustrates a homogenizer in accordance with the invention, in a first implementation example, in side view.
Figure 2:
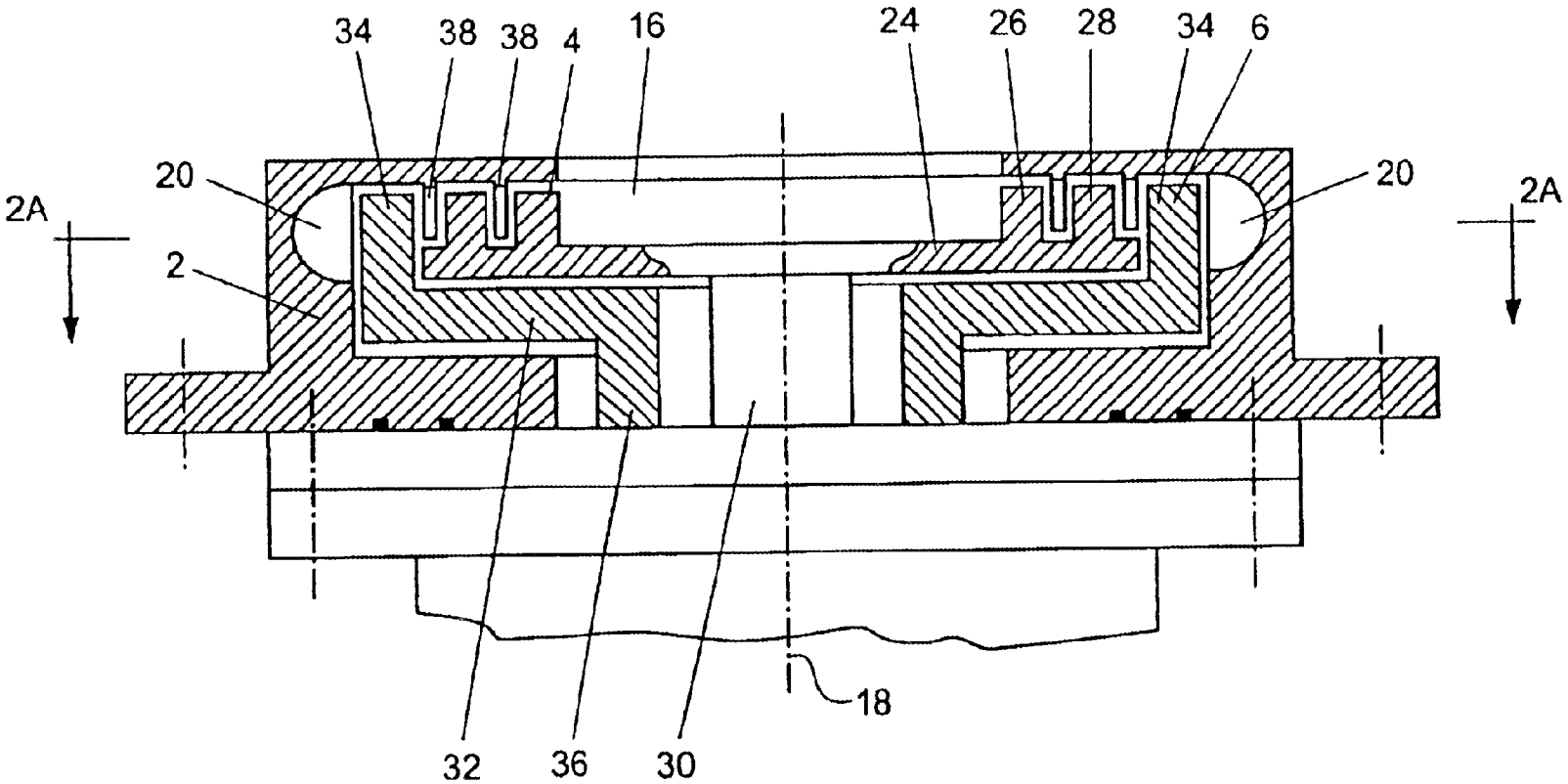
FIG. 2 is a partial cutaway illustration of the homogenizer in FIG. 1.
Figure 2A:
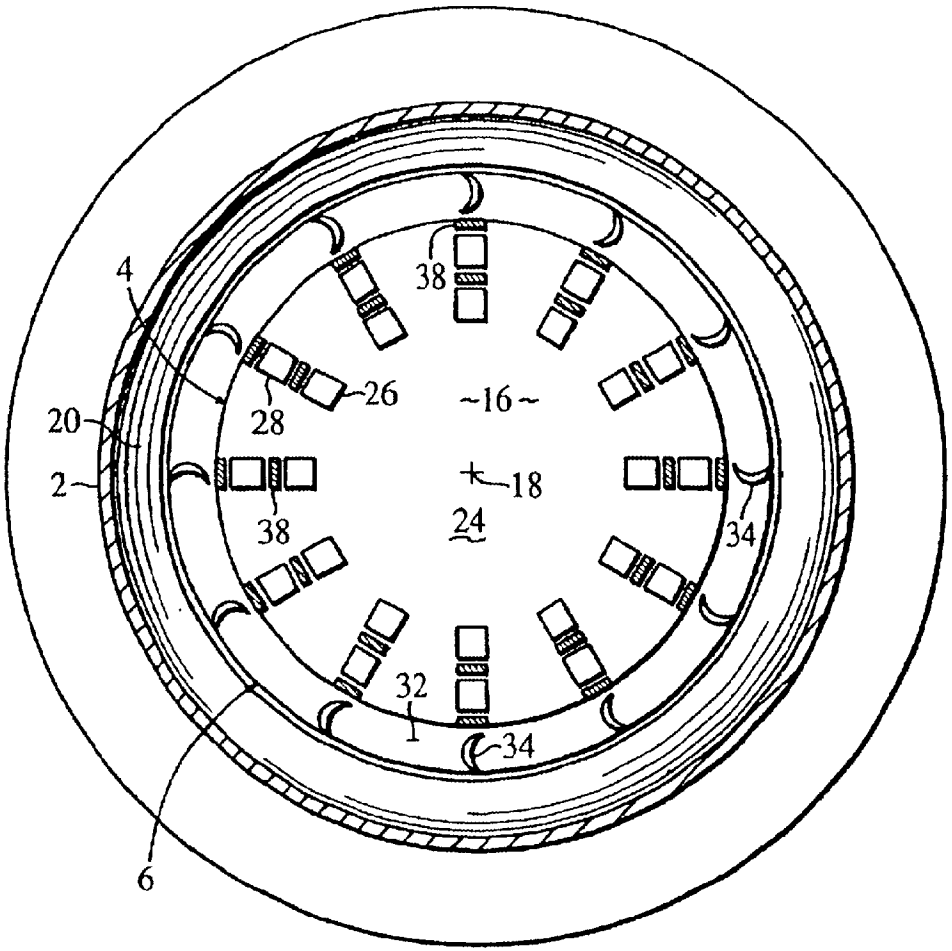
FIG. 2A is a top view of the homogenizer in FIG. 1.

The homogenizer illustrated in FIGS. 1, 2, 2A, and 3 consists essentially of a rotor 4 mounted in a housing 2, a rotatable element 6 which is also positioned within the housing 2 for homogenizing and/or transporting, and a drive device 8 which drives the rotor 4, and independently of it the rotatable element 6. The homogenizer can be attached by means of a housing or adapter 10 to a stirring container or the like, whose wall 12 is illustrated, in such a way that a liquid substance can flow from the interior of the stirring container through an inlet opening 14 axially, that is, in the direction of a longitudinal axis 18, into the interior 16 of the homogenizer. In the housing 2 there is a circulating channel 20 which has an outlet opening which is not shown, which opening communicates with a return line 22 through which the liquid substance can be conducted back into either the lower area or the upper area of the container. Alternatively, the substance can be conveyed to a filling facility. Alternatively, the homogenizer can be set up separately from a container.

The rotor 4 has a round base plate 24 (see FIG. 2) and several blades 26, 28 which extend axially from the base plate 24, where most of the blades 26 are arranged at intervals from each other around an inner concentric circle and the blades 28 are arranged at intervals from each other around an outer concentric circle. The blades 26 are designed in a known manner in such a way that the substance which is to be homogenized is caught by the blades 26 and transported radially toward the outside (in reference to the longitudinal axis 18) and at the same time is subjected to shearing forces. To drive and rotate the blades 26, 28, the base plate 24 is coupled with an inner drive shaft 30.

The rotatable element 6 in the implementation example is constructed as an impeller, with several pump buckets 34 which extend axially from an additional disk-shaped base plate 32; the pump buckets 34 are arranged along a circle which is concentric to the blades 26, 28, and are designed in a known fashion in such a way that the liquid substance is transported with a relatively high pumping power through the homogenizer into the channel 20. The base plate 32 is coupled as a single piece with an outer drive shaft 36, which is concentric to the drive shaft 30 and is constructed as a hollow shaft. The base plates 24 and 32 are positioned essentially parallel to each other.

To increase the homogenizing and/or dispersion effect of the homogenizer, there are several stator elements or rings on the housing 2 which extend inward into the interior 1 6 and form a stator 38; they are in multiple stages, in the implementation example in two stages. Inner stator elements are located between the blades 26 or 28, viewed in the radial direction, and additional stator elements are placed between the blades 28 and the pump buckets 34 of the rotatable element 6.

The drive device 8, with which the rotor 4 and the rotatable element 6 can be driven independently of each other, is explained in the following section on the basis of FIGS. 1, 2, 2A, and 3. The drive shafts 30, 36 can be driven with the help of gear wheels 40 and 42 attached to their end sections, toothed belts 44 and 46, gearing mechanisms 48, 50 and electric motors 52, 54 at adjustable speeds in both directions, in such a way that the rotor 4 and the rotatable element 6 are rotating in the same or opposite directions. In addition, the rotor 4 or the rotatable element 6 can be stopped while the other part rotates. The gearing mechanisms 48, 50 and the electric motors 52, 54 can be arranged at offsets or rotated around longitudinal axes 56, 68.

The outer drive shaft 36 is supported by means of two bearings 60, 62—these can be roller or slide bearings—in a housing 64 which is flange-mounted to the housing 2 of the homogenizer. The base plate 32 of the rotatable element 6 with its pump buckets 34 is rigidly connected to an upper end section of the drive shaft 36 with the help of screws 66; naturally other means of fastening can be used instead of the screws, or a single-unit construction can be used. In the lower area the housing 64 is closed with a cover 68 which at the same time stabilizes the bearing 62.

The inner drive shaft 30 which drives the rotor 4 is supported in the drive shaft 36 by means of two bearings 70, 72 so that it can rotate. All bearings 62, 64, 70, 72 are filled with sufficient lubricant ("self-lubricating"), and are secured in the prescribed positions with the help of retaining rings and sleeves.

Figure 3:
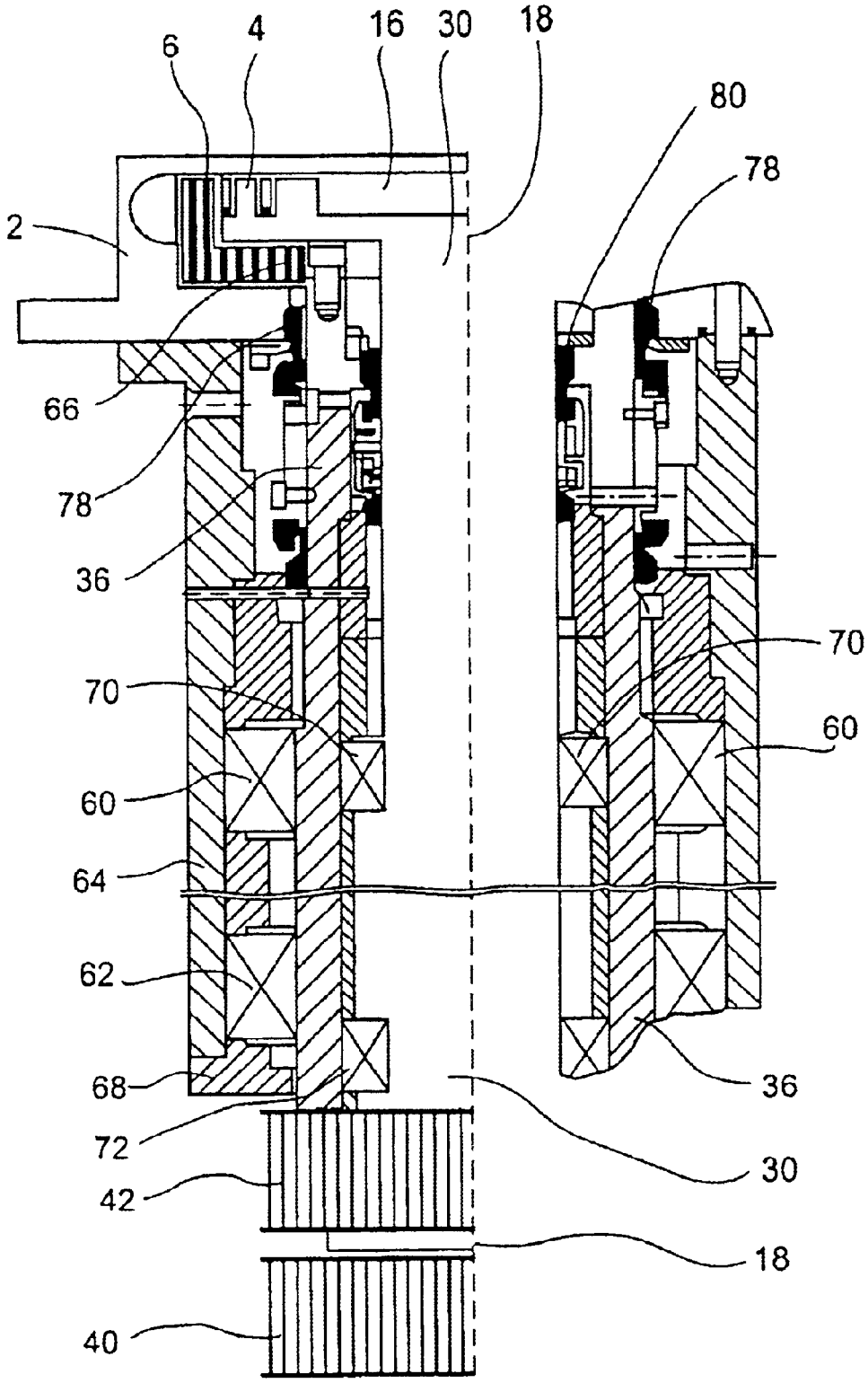
FIG. 3 is an additional partial cutaway illustration of the homogenizer in FIG. 1.

To seal the interior 16 of the homogenizer against the external surroundings, there are two sliding ring seals 78, 80, each with four sliding rings. Alternatively other shaft seals could be used such as lip seal rings or the like. An upper sliding ring of the sliding ring seal 78 is connected firmly to the housing 2, while a lower sliding ring is fastened to the drive shaft 36 and rotates with it, so that liquid substance cannot flow from the interior 16 into the interior of the housing 62. One ring of the sliding ring seal 80 which is shown in FIG. 3 on top is fastened to the interior of the drive shaft 36 and can move relative to a lower ring of the sliding ring seal 80, which is firmly fastened to the outside of the drive shaft 30, so that no liquid substance can get past the sliding ring seal 80 and flow from the interior 16 into the interior of the housing 64.

Figure 4:
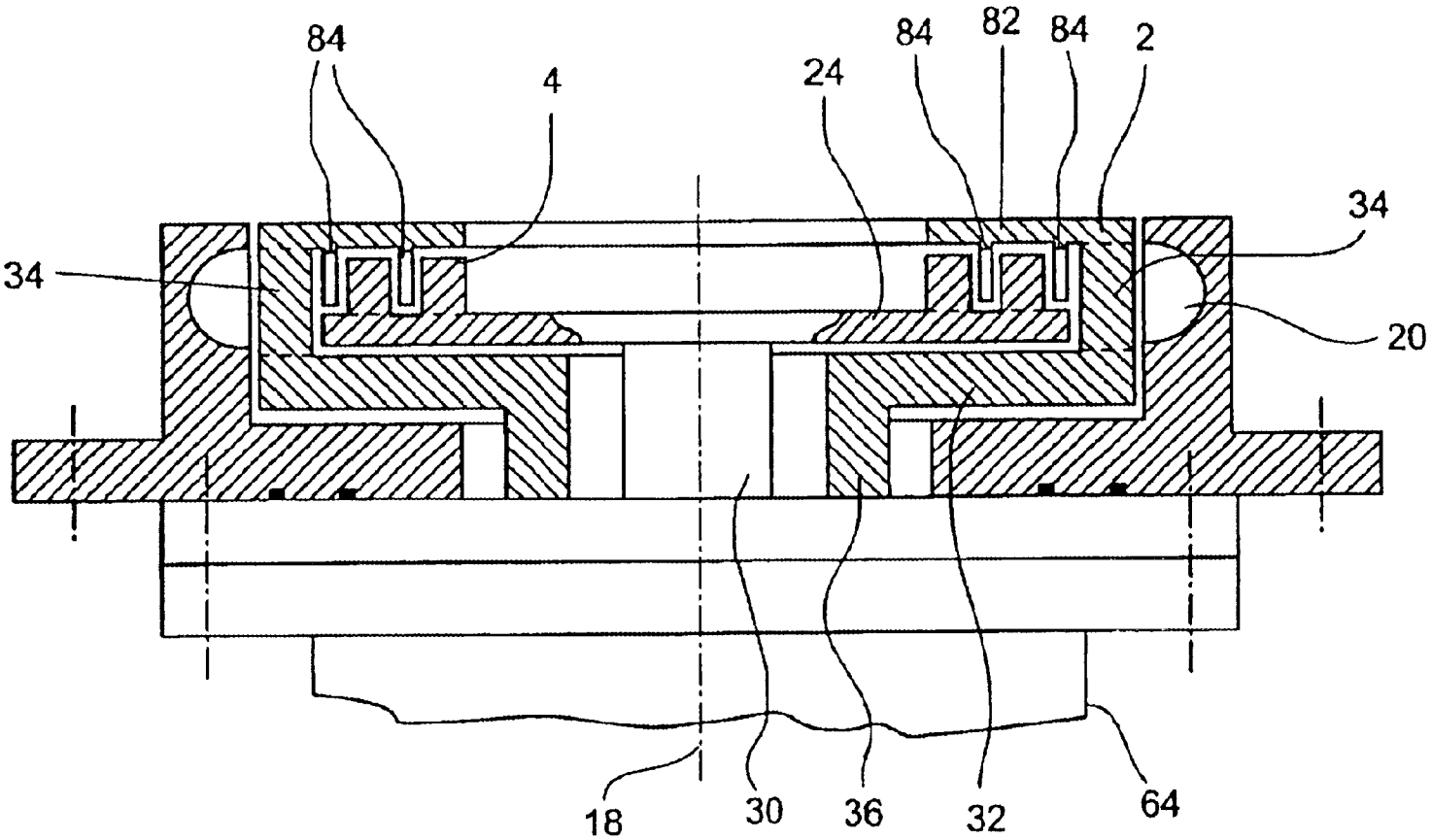
FIG. 4 is a section of an additional homogenizer in accordance with a second implementation example, in a partial cutaway view.

The implementation example of a homogenizer in accordance with the invention which is partially shown in FIG. 4 is in principle similar in design to the implementation example described above, so that to avoid repetition we refer in full to the above description and wilt describe only differences below. The rotor 4 is driven by means of the drive shaft 30, toothed belt 44 and gearing mechanism 48 and the drive motor 52. The rotatable element 2 is driven by means of the outer drive shaft 36, toothed belt 46, gearing mechanism 50 and drive motor 54 independent of the rotor 4. The rotatable element 2 has outer pump buckets 34 fastened to the base plate 32, which pass over into an upper ring wheel 82 which is directed radially upward, on which are formed blade or stator elements 84 which extend axially in the direction of the base plate 24 in the manner of a stator; these elements are arranged between the pump buckets 34 and the blades 28, or between the blades 26 and 28, and increase the shearing effect. The stator elements 84 can rotate together with the rotatable element 2 and the pump stator elements 34. Since the buckets 84 are formed in the manner of a conventional stator and are rotatable, one can also speak of a "dynamic stator."

Figure 5:
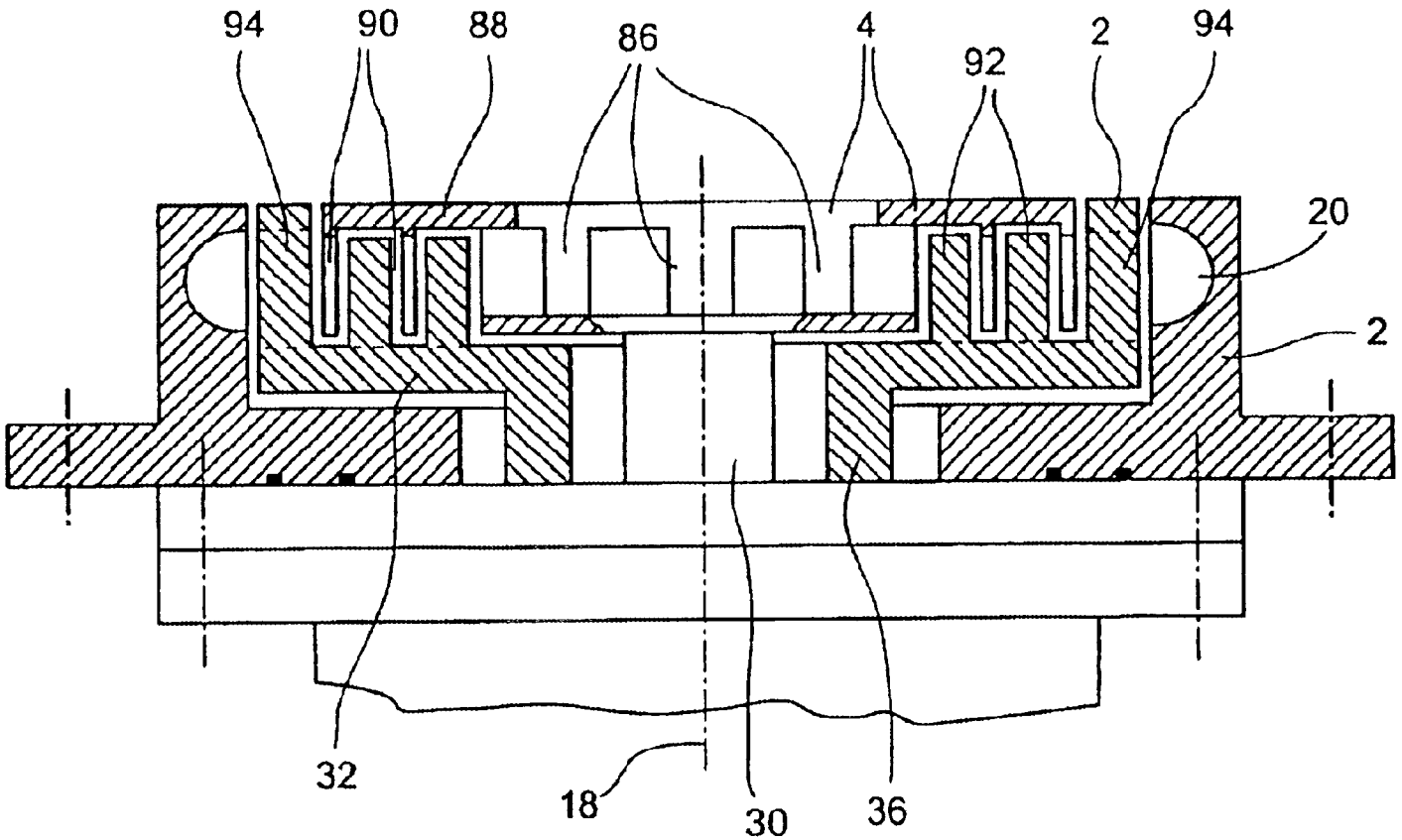
FIG. 5 is a section of an additional homogenizer in accordance with a third implementation example, in a partial cutaway view.

The other implementation example, described on the basis of FIG. 5, is also similar to the implementation examples already described, so that we refer to the descriptions above and will only describe differences. The rotor 4, which is driven by means of the drive shaft 30, has a number of fins 86 attached to the base plate 24 which are connected with a circular disk 88. Extending axially inwardly from the circular disk 88 are stator elements 90 formed in the manner of a stator, which can rotate around the longitudinal axis 18. The rotatable element 2, which is coupled with the drive shaft 36, has inner pump buckets or elements 92 formed in the manner of a rotor, as well as outer pump buckets 94. The stator elements 90 are positioned between the outer pump buckets 94 and the elements 92.

Figure 6:
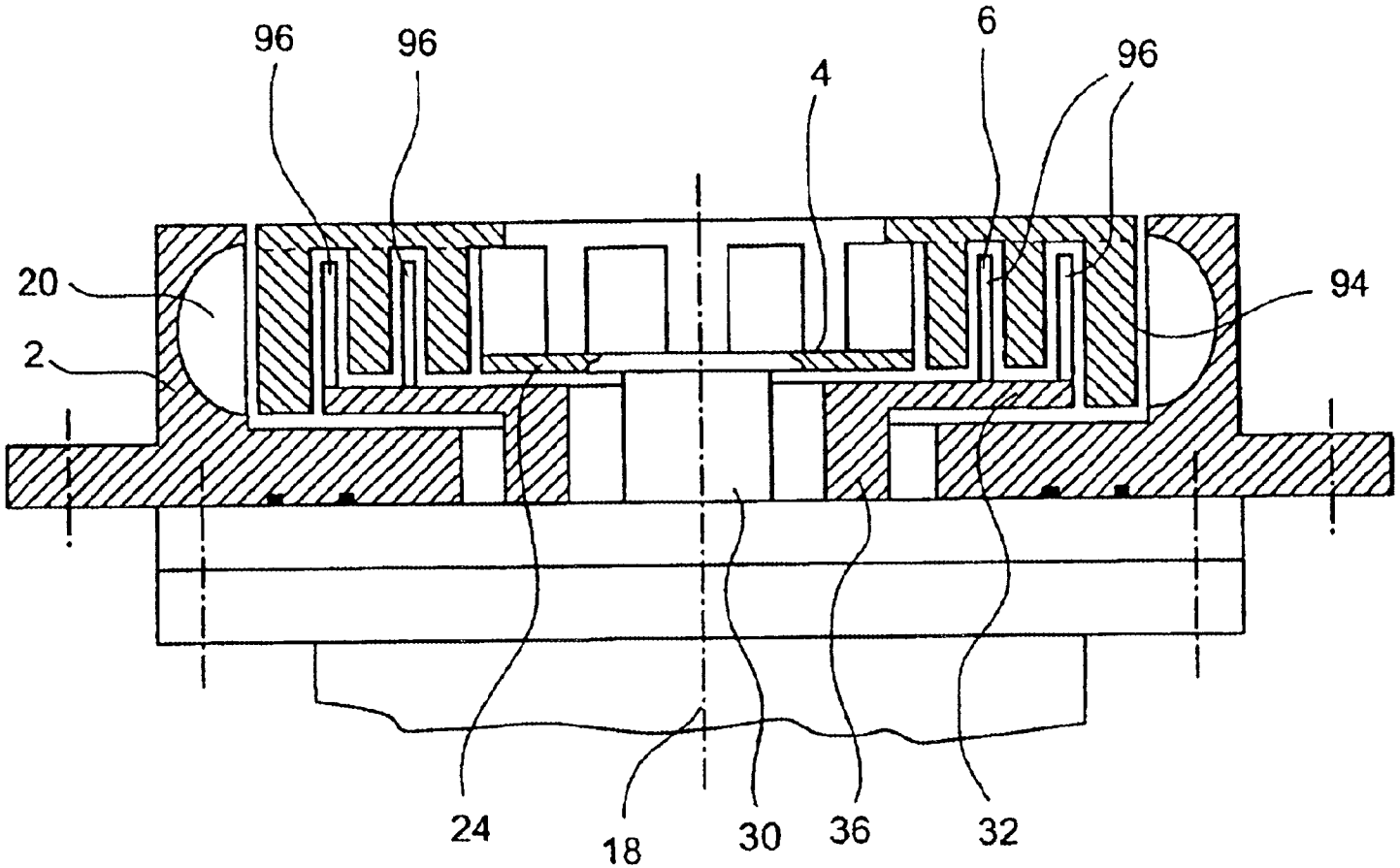
FIG. 6 is a section of an additional homogenizer in accordance with a fourth implementation example, in a partial cutaway view.

Finally, with regard to the additional implementation example shown in FIG. 6, we also refer to the above descriptions and will explain only the differences below. The rotor 4, which is coupled with the drive shaft 30, is designed in the same way as the implementation example described above on the basis of FIG. 5. The element 6 which can be rotated by means of the drive shaft 36 is constructed in the manner of a stator, and has stator elements 96 which extend axially from the base plate 32.

What is claimed is:

1. A homogenizer for homogenizing a free-flowing substance, comprising:

a housing;

a rotor mounted for rotation in the housing and having a plurality of rotor blades disposed thereon;

a drive device coupled rotate the rotor;

a rotatable element coupled to the drive device and mounted for rotation in the housing, the rotatable element comprising a plurality of pump buckets and driven for rotation independent of the rotor to thereby homogenize and/or transport the free-flowing substance; and a plurality of stator blades disposed within the housing, at least some of the stator blades positioned between the rotor blades and the pump buckets.

2. The homogenizer of claim 1, wherein the plurality of stator blades are mounted to the housing.

3. The homogenizer of claim 1, wherein the plurality of stator blades are mounted for rotation with the rotatable element.

4. The homogenizer of claim 1, wherein the plurality of pump buckets include inner pump buckets and outer pump buckets, the inner pump buckets positioned radially inward of the outer pump buckets, and wherein the stator blades are disposed between the inner and outer pump buckets.

5. A homogenizer for homogenizing a free-flowing substance, comprising:

a first housing, a rotor which is mounted for rotation in the first housing, a drive device coupled to rotate the rotor, a rotatable element coupled to the drive device and mounted for rotation in the first housing, the rotatable element driven for rotation independently of the rotor for homogenizing and/or transporting the free-flowing substance, and the rotatable element being constructed as an impeller with a plurality of pump buckets, an outer drive shaft supported in a second housing, and an inner drive shaft coaxially supported in the outer drive shaft by roller bearings, at least one of the inner drive shaft and the outer drive shaft being constructed as a hollow shaft, wherein the inner drive shaft and the outer drive shaft are coupled with the rotatable element and the rotor to drive the rotatable element or the rotor.

6. A homogenizer for homogenizing a free-flowing substance, comprising:

a housing, a rotor which is mounted for rotation in the housing, a drive device coupled to rotate the rotor, a rotatable element coupled to the drive device and mounted for rotation in the housing, the rotatable element driven for rotation independently of the rotor for homogenizing and/or transporting the free-flowing substance, and the rotatable element being constructed as an impeller with a plurality of pump buckets, two coaxial drive shafts coupled with the rotatable element and the rotor to drive the rotatable element or the rotor, and at least one shaft seal for sealing the interior of the housing against the surroundings.

7. The homogenizer of claim 6, wherein the shaft seal is a sliding ring seal.

8. A homogenizer for homogenizing a free-flowing substance, comprising:

a housing having a control valve, an inlet opening through which the free-flowing substance can flow axially from a container into the interior of the housing, and a return line communicating with the housing and through which the liquid substance can be conveyed back to various locations in the container depending on the position of the control valve, a rotor which is mounted for rotation in the housing, a drive device coupled to rotate the rotor, a rotatable element coupled to the drive device and mounted for rotation in the housing, the rotatable element driven for rotation independently of the rotor for homogenizing and/or transporting the free-flowing substance, and the rotatable element being constructed as an impeller with a plurality of pump buckets, and two coaxial drive shafts coupled with the rotatable element and the rotor to drive the rotatable element or the rotor.

9. A homogenizer for homogenizing a free-flowing substance, comprising:

a housing, a rotor which is mounted for rotation in the housing, a drive device coupled to rotate the rotor, a rotatable element coupled to the drive device and mounted for rotation in the housing, the rotatable element driven for rotation independently of the rotor for homogenizing and/or transporting the free-flowing substance, and the rotatable element being constructed as an impeller with a plurality of pump buckets, two coaxial drive shafts coupled with the rotatable element and the rotor to drive the rotatable element or the rotor, and fixed-position stator interleavings arranged on the housing.

10. A homogenizer for homogenizing a free-flowing substance, comprising:

a housing;

a rotor which is mounted for rotation in the housing, a drive device coupled to rotate the rotor, a rotatable element coupled to the drive device and mounted for rotation in the housing, the rotatable element driven for rotation independently of the rotor for homogenizing and/or transporting the free-flowing substance, and the rotatable element being constructed as an impeller with a plurality of pump buckets, respective drive motors coupled to the rotor and the rotatable element, the drive motors being controlled such that the rotor and the rotatable element can be rotated at adjustable relative speeds in the same or opposite directions, or such that either the rotor or the rotatable element is driven while the other component stands still, and at least one shaft seal is provided to seal the interior of the housing against the surroundings.

11. The homogenizer of claim 10, wherein the shaft seal is a sliding ring seal.

12. A homogenizer for homogenizing a free-flowing substance, comprising:

a housing having a control valve, an inlet opening through which the free-flowing substance can flow axially from a container into the interior of the housing, and a return line communicating with the housing and through which the liquid substance can be conveyed back to various locations in the container depending on the position of the control valve, a rotor which is mounted for rotation in the housing, a drive device coupled to rotate the rotor, a rotatable element coupled to the drive device and mounted for rotation in the housing, the rotatable element driven for rotation independently of the rotor for homogenizing and/or transporting the free-flowing substance, and the rotatable element being constructed as an impeller with a plurality of pump buckets, and respective drive motors coupled to the rotor and the rotatable element, the drive motors being controlled such that the rotor and the rotatable element can be rotated at adjustable relative speeds in the same or opposite directions, or such that either the rotor or the rotatable element is driven while the other component stands still.

13. A homogenizer for homogenizing free-flowing substances comprising:

a housing, a rotor which is mounted for rotation in the housing, a drive device coupled to rotate the rotor, a rotatable element coupled to the drive device and mounted for rotation in the housing, the rotatable element driven for rotation independently of the rotor for homogenizing and/or transporting the free-flowing substance, and the rotatable element being constructed as an impeller with a plurality of pump buckets, respective drive motors coupled to the rotor and the rotatable element, the drive motors being controlled such that the rotor and the rotatable element can be rotated at adjustable relative speeds in the same or opposite directions, or such that either the rotor or the rotatable element is driven while the other component stands still, and fixed-position stator interleavings arranged on the housing.

* * * * *

UNITED STATES PATENT AND TRADEMARK OFFICE

CERTIFICATE OF CORRECTION

PATENT NO. : 6,866,412 B2
DATED : March 15, 2005
INVENTOR(S) : Heinz-Jurgen Bachelier et al.

It is certified that error appears in the above-identified patent and that said Letters Patent is hereby corrected as shown below:

Column 5,
Line 52, insert -- to -- after "coupled".

Signed and Sealed this

Thirteenth Day of September, 2005

JON W. DUDAS
*Director of the United States Patent and Trademark Office*